United States Patent [19]

Lee

[11] Patent Number: 4,984,379

[45] Date of Patent: Jan. 15, 1991

[54] PEN STRUCTURE WITH A FLAG

[76] Inventor: Victor Lee, 2F., No. 30, Lane 89, Wen Sheng Street, Panchiao City, Taipei Hsien, Taiwan

[21] Appl. No.: 468,145

[22] Filed: Jan. 22, 1990

[51] Int. Cl.[5] ..... G09F 19/06

[52] U.S. Cl. ..... 40/334; 401/195

[58] Field of Search ..... 40/334, 335, 358; 401/195

[56] References Cited

U.S. PATENT DOCUMENTS

| | | | |
|---|---|---|---|
| 1,049,275 | 12/1912 | Scott | 40/334 |
| 1,262,972 | 4/1918 | Olson | 40/334 |
| 1,561,725 | 11/1925 | Kerley | 40/334 |
| 2,005,110 | 6/1935 | Ritzert | 40/334 |
| 4,787,161 | 11/1988 | Feng | 40/334 |

*Primary Examiner*—Richard J. Johnson

*Attorney, Agent, or Firm*—Bacon & Thomas

[57] ABSTRACT

A writing instrument is disclosed having a display flag attached to an internal pen holder such that the flag may be displayed either by pulling it laterally through any elongated opening in an external pen holder, or by axially extending the internal pen holder from the external pen holder. A positioning block attached to the internal pen holder limits the relatively axial sliding movement between the internal and external pen holders to prevent the user from completely pulling the internal pen holder from the external pen holder. The writing instrument may also be placed in a base such that the flag may be displayed while the base rests on a desk, table, or the like.

5 Claims, 4 Drawing Sheets

PEN STRUCTURE WITH A FLAG

BACKGROUND OF THE INVENTION

This invention relates to a pen structure having a flag collecting/releasing function.

Most of the high quality pens used to attract consumers present a delicate and elegant surface which is made in the design of various patterns of beautiful streaks, or by the accomplishment of a smooth and impeccable surface treatment. In recent years, owing to the highly developed culture of consumers, a mere alteration made to the surface decoration of a pen will no longer attract the consumers. Also, owing to the upgraded development of pen fabrication, it is quite impossible to make any further breakthroughs to distinguish their special characteristics. Therefore, the problem arises of how to increase the added value to the marketability of this merchandise. As consumers are paying more attention to the regenerative value of pens, a prevailing trend is to upgrade the quality of the pen by improving its internal structure by improving the singular function of a simple pen core and handle structure which has existed for so long.

SUMMARY OF THE INVENTION

The main object of this invention is to provide a pen structure having the capability of collecting and releasing a flag, so as to upgrade the value of the product.

This invention is so designed that it has an internal pen holder of which is of a C shape located inside an external pen holder. Into the aforementioned internal pen holder, the core of the pen and the flag are inserted. At one end of the internal pen holder two fixed rings are firmly located. A positioning block is located between the two fixed rings. Into its other end, a pen and sleeve are inserted to tightly clip the flag such that a long square guiding hole formed in the external pen holder will serve as an inlet for the flag. The flag may be collected or displayed by revolving the end sleeve of the pen, or by pulling the flag away from the internal pen holder.

To illustrate the achieving of the above-mentioned objects, a preferred embodiment illustrated with the attached drawings will be set below to allow a better understanding of the structure and features of this invention.

DETAILED DESCRIPTION OF THE PREFERRED EMBODIMENT

Figure 1:
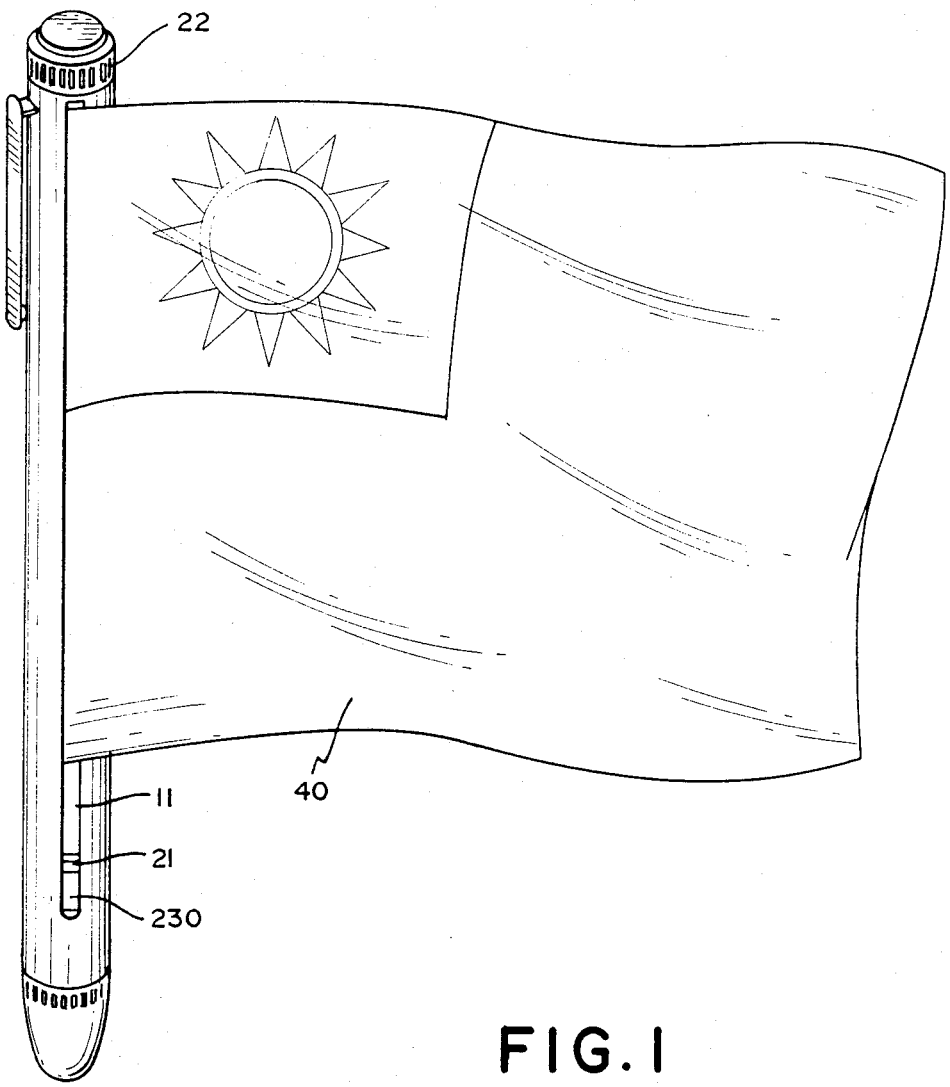
FIG. 1 is a perspective view of the pen structure according to the invention.
Figure 2:
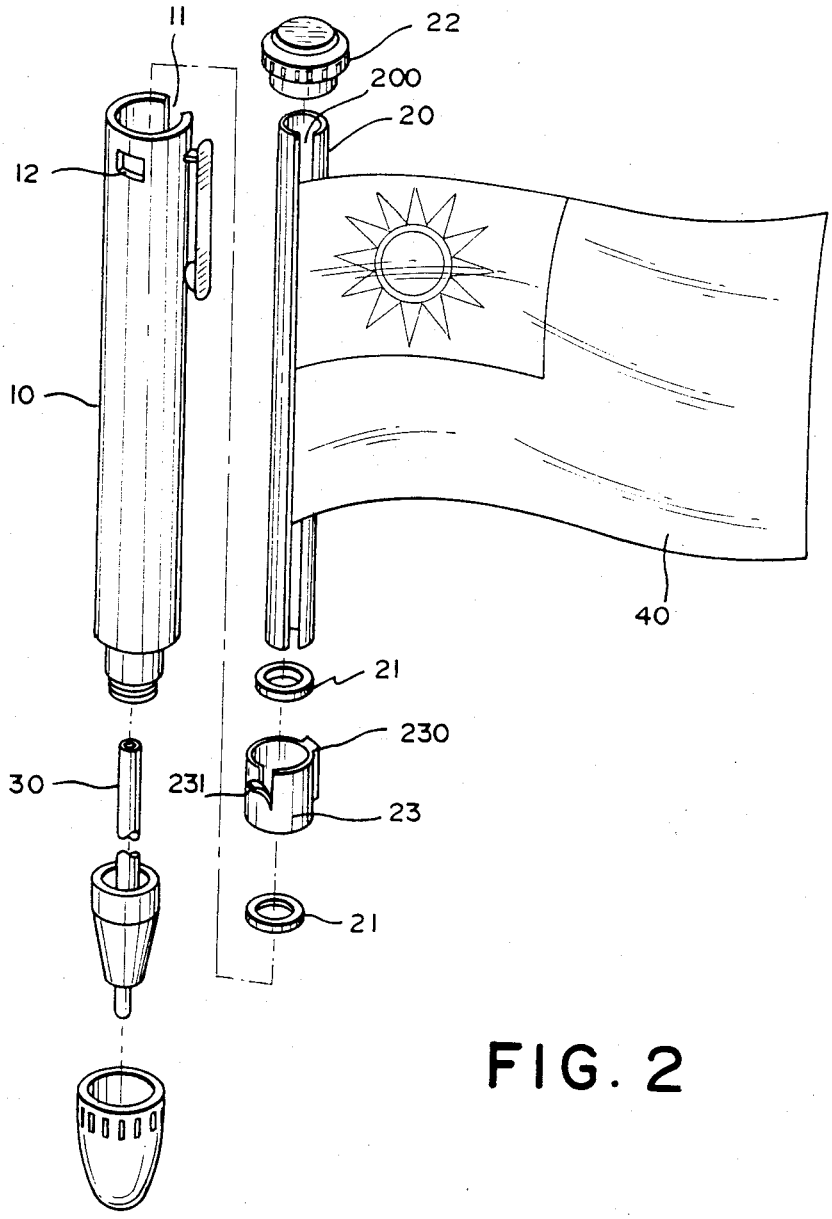
FIG. 2 is an exploded view of the pen structure shown in FIG. 1.

As illustrated in FIGS. 1 and 2, the features of the pen structure mainly lie in an internal pen holder 20 set inside an external pen holder 10, by means of which the core of the pen can be mounted and the object of collecting and releasing the flag 40 can be achieved.

An elongated opening 11 extends downwardly from an end of the external pen holder 10 an appropriate length to accommodate flag 40. An obstruction hole 12 is formed through the external pen holder 10 to prevent the internal pen holder 20 from falling off during its upward and downward movement.

Figure 3:
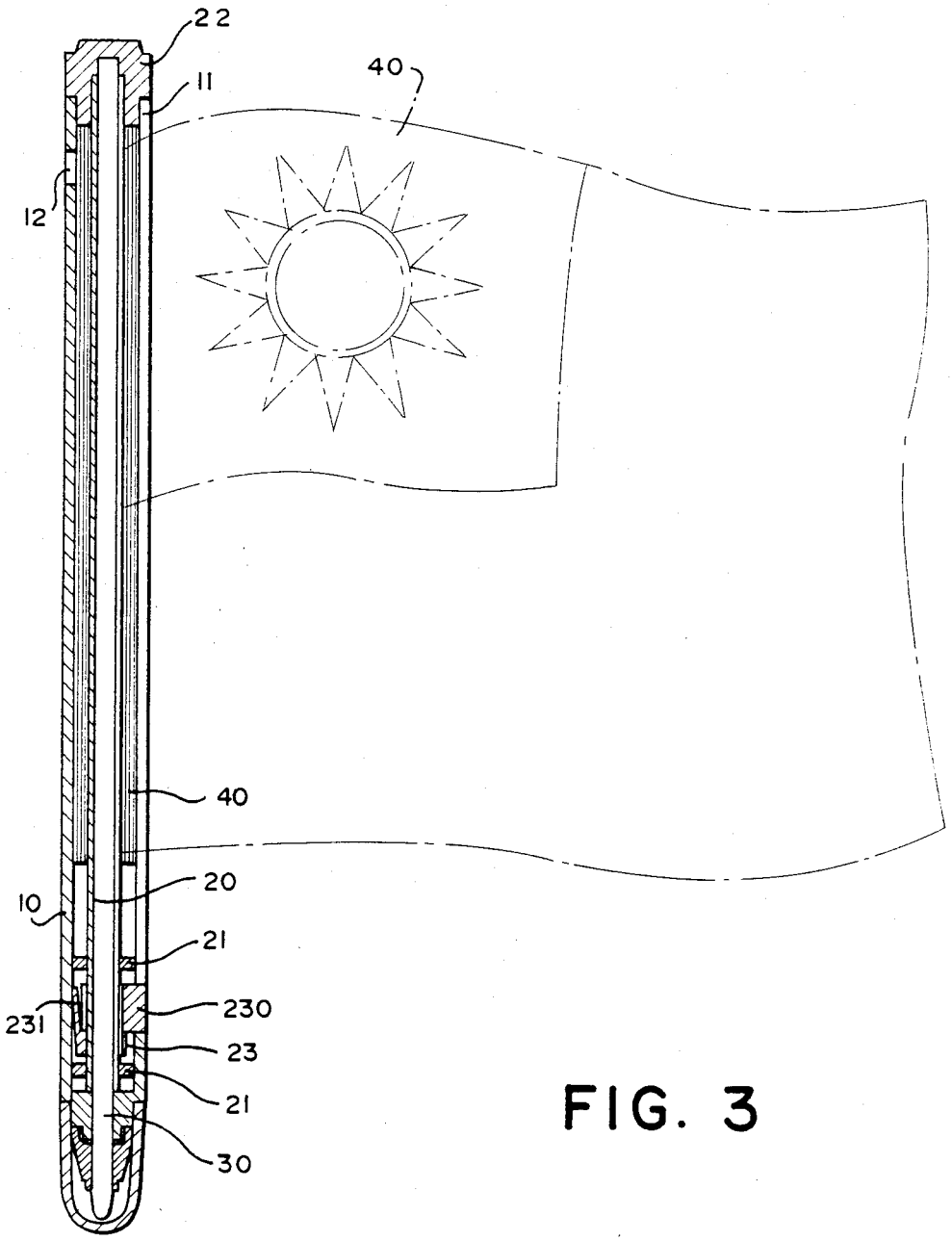
FIG. 3 is a cross-sectional view of the pen structure shown in FIGS. 1 and 2.
Figure 4:
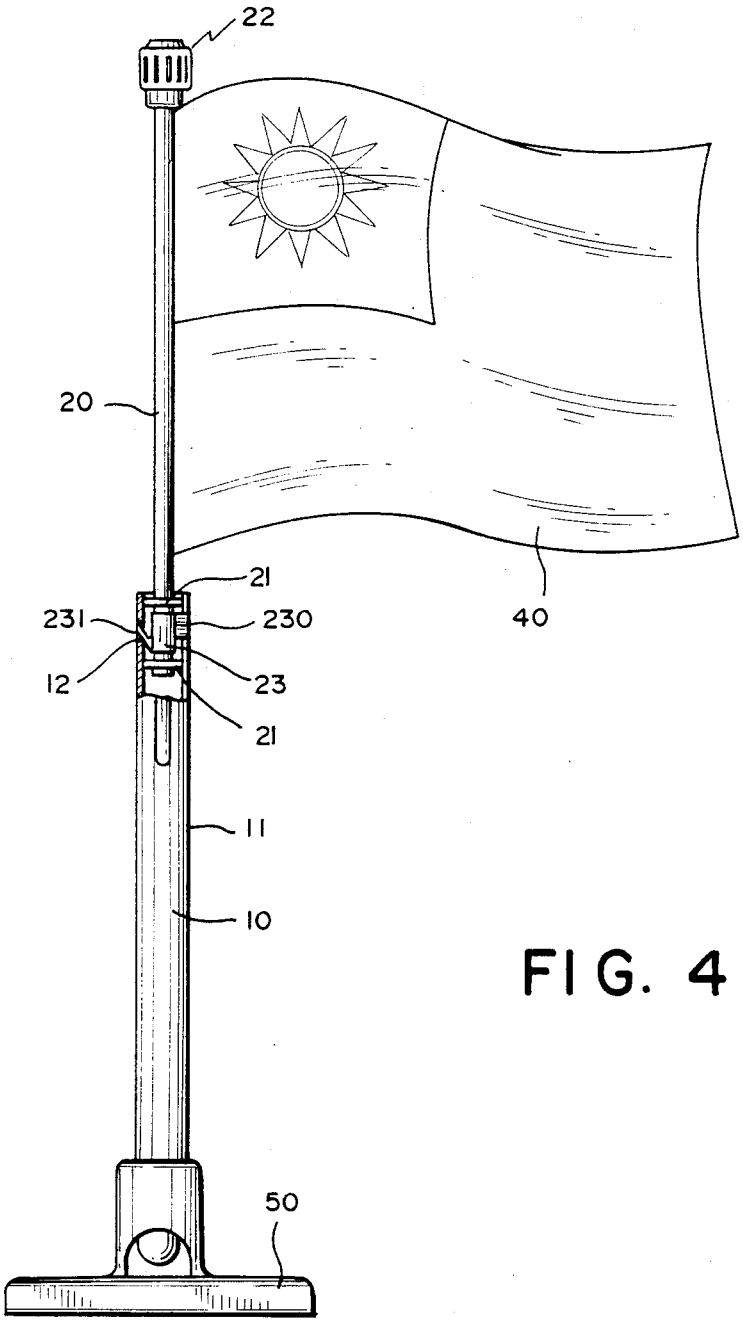
FIG. 4 is an elevational view, partly in section of the pen structure according to the invention.

The internal pen holder 20 is made in the shape of a hollow straight cylindrical body, the external diameter of which is approximately ½ the interior diameter of the external pen holder 10, and having a slot 200 set extending from one end to the other end such that it has a C shape. The internal pen holder 20 is tightly received in two fixed rings 21 at one end and a cap 22 at the other end and is slidably received in the interior hole of the external pen holder 10. The slot 200 is closed by rings 21 and cap 22 to function as a clip for the clipping of the flag 40. Internal pen holder 20 also accommodates the core 30 of the pen in the external pen holder 10. Further, by using the core 30 of the pen as a revolving axis, a revolving motion applied to the cap 22 of the pen will easily achieve the object of collecting the flag within the external pen holder 10. As shown in FIG. 3, it can be seen that a positioning block 23 is located on the internal pen holder 20 at a position which lies in between the two fixed rings 21. At the axial periphery of the positioning block 23, an elongated projected edge 230 is located such that it extends into elongated opening A flexible tenon 231 extends outward from the positioning block 23. Said tenon piece 231 extends outwardly from the top end, so that it can be pushed into obstruction hole 12 when internal pen holder 20 is pulled upwardly by cap 22 to limit further movement in this direction. Downward motion of internal pen holder 20 is restricted by engagement of projected edge 230 and the bottom of elongated opening 11 formed on the external pen holder 10. After the internal pen holder 20 has been pulled out of the external pen holder 10 through means of the end cap and the engagement of the tenon 231 and the obstruction hole 12 has taken place, the flag 40 can be stretched out and displayed. By directly making use of the elongated opening 11 in the external pen holder 10, the flag 40 can be pulled out and displayed. The external pen holder 10 can be put upright on a base seat 50 as a table decoration as shown in FIG. 4.

The foregoing description is provided for illustrative purposes only and should not be construed as limiting this invention, the scope of which is defined solely by the appended claim.

I claim:

1. A writing instrument having means to display a flag or the like comprising:

(a) an external pen holder having generally hollow cylindrical shape and defining an elongated opening extending along less than the length of the external pen holder, through a wall of the external pen holder, the elongated opening having a bottom;

(b) an internal pen holder axially slidably and rotatably received in the external pen holder having a generally hollow cylindrical shape, the internal pen holder defining a slot extending completely along its length such that the internal pen holder has a generally "C" shaped cross-sectional configuration;

(c) an obstruction hole defined by the external pen holder near an upper end thereof;

(d) a positioning block fixedly attached to a lower portion of the internal pen holder, the positioning block having a projecting edge extending into the elongated opening in the external pen holder and a flexible tenon extending from a side thereof such that relative axial sliding movement between the internal and external pen holders is limited in a first direction by contact between the projecting edge of the positioning block and the bottom of the elongated opening and in an opposite direction by engagement of the obstruction hole and the flexible tenon; and, (e) means attached to the internal pen holder to deform its cross-sectional shape so as to close the slot such that an edge of the flag or the like is clamped onto the internal pen holder.

2. The writing instrument according to claim 1 wherein the means to deform the cross-sectional shape comprises at least one ring placed around the internal pen holder.

3. The writing instrument according to claim 2 wherein the means to deform the cross-sectional shape comprises a pair of rings disposed around the internal pen holder.

4. The writing instrument according to claim 3 wherein the pair of rings are located adjacent to and on either side of the positioning block.

5. The writing instrument according to claim 4 further comprising a cap fixedly attached to the internal pen holder and extending exteriorly of the external pen holder.

* * * * *